US008118642B2

(12) United States Patent
Coulon et al.

(10) Patent No.: US 8,118,642 B2
(45) Date of Patent: Feb. 21, 2012

(54) METHOD AND MACHINE TOOL FOR MACHINING AN OPTICAL OBJECT

(75) Inventors: Alain Coulon, Charenton Cedex (FR); Jean-Pierre Chauveau, Charenton Cedex (FR); Alain Dubois, Charenton Cedex (FR)

(73) Assignee: Essilor International, Charenton-le-Pont (FR)

( * ) Notice: Subject to any disclaimer, the term of this patent is extended or adjusted under 35 U.S.C. 154(b) by 540 days.

(21) Appl. No.: 12/306,127

(22) PCT Filed: Jun. 13, 2007

(86) PCT No.: PCT/FR2007/000982
§ 371 (c)(1),
(2), (4) Date: Dec. 22, 2008

(87) PCT Pub. No.: WO2007/147958
PCT Pub. Date: Dec. 27, 2007

(65) Prior Publication Data

US 2009/0304472 A1 Dec. 10, 2009

(30) Foreign Application Priority Data

Jun. 22, 2006 (FR) ..... 06 05622

(51) Int. Cl.
*B24B 7/00* (2006.01)

(52) U.S. Cl. ..... 451/7; 451/63; 451/42; 451/123

(58) Field of Classification Search ..... 451/5, 11, 451/63, 42, 123, 240, 256; 409/131
See application file for complete search history.

(56) References Cited

U.S. PATENT DOCUMENTS 4,989,316 A * 2/1991 Logan et al. ..... 29/527.3
5,231,587 A * 7/1993 Frost ..... 700/164
5,417,130 A * 5/1995 Dorsch ..... 82/1.11
5,681,209 A * 10/1997 Naumann et al. ..... 451/51
5,895,311 A * 4/1999 Shiotani et al. ..... 451/5
5,938,381 A * 8/1999 Diehl et al. ..... 409/132
5,957,637 A 9/1999 Savoie
5,971,836 A * 10/1999 Kogure et al. ..... 451/41

(Continued)

FOREIGN PATENT DOCUMENTS

CA 2356497 2/2003

(Continued)

OTHER PUBLICATIONS

International Search Report dated Dec. 6, 2007 in PCT application.

*Primary Examiner* — George Nguyen
(74) *Attorney, Agent, or Firm* — Young & Thompson

(57) ABSTRACT

A method for machining a face (1) of an optical object (6), includes providing a machine tool which itself includes a bed (1) for locating an object to be machined. The bed (1) has a receiving surface (3) that is angularly adjustable about an axis perpendicular to the receiving surface (3). A spindle (8) is suitable for rotating a machining tool (9) about an axis essentially parallel to the receiving surface (3) of the bed (1) and is suitable for moving the machining tool (9) translationally in a plane essentially parallel or perpendicular to the receiving surface (3) of the bed (1).

20 Claims, 6 Drawing Sheets

U.S. PATENT DOCUMENTS

| | | | | |
|---|---|---|---|---|
| 6,106,366 | A * | 8/2000 | Dixon et al. | 451/10 |
| 6,478,658 | B1 * | 11/2002 | Logan | 451/5 |
| 7,104,870 | B2 * | 9/2006 | Fong et al. | 451/41 |
| 7,373,706 | B2 * | 5/2008 | Savoie | 29/27 C |
| 7,476,143 | B2 * | 1/2009 | Shibata | 451/5 |
| 7,494,305 | B2 * | 2/2009 | Riall et al. | 409/132 |
| 2006/0189255 | A1 * | 8/2006 | Akiyama | 451/5 |
| 2007/0049175 | A1 * | 3/2007 | Kim et al. | 451/11 |
| 2008/0026678 | A1 * | 1/2008 | Kim et al. | 451/11 |

FOREIGN PATENT DOCUMENTS

| | | |
|---|---|---|
| DE | 4412370 | 10/1995 |
| DE | 19616526 | 11/1997 |

* cited by examiner

METHOD AND MACHINE TOOL FOR MACHINING AN OPTICAL OBJECT

BACKGROUND OF THE INVENTION

1. Field of the Invention

The invention concerns the field of the fabrication of optical objects, such as ophthalmic lenses, molds or inserts, for example.

The invention more particularly concerns a method of machining one face of such an optical object.

2. Description of the Related Art

Machining optical objects generally necessitates particular attention as to the precision and the regularity of the machined shapes. In particular, machining defects linked to wear of the tool employed for this machining must be avoided.

Under these conditions, complex and costly machines necessitating delicate calibration are generally employed in this field.

For example, the document U.S. Pat. No. 5,231,587 describes a machine tool for lenses including a spherical tool mounted turning about its longitudinal axis, called the first axis, this tool moreover being orientable angularly by its pivoting about a second axis perpendicular to the first axis. A part-carrier, intended to support the lens, is arranged in a similar manner and enables rotation of the lens about a third axis, coplanar with the first axis, and enables angular orientation of the lens by its pivoting about a fourth axis perpendicular to the third axis.

There is also known from the document JP 2005 22 49 27 a machining method in the course of which a machining tool is positioned relative to a part to be machined so that the vector connecting a machining point and the center of the tool forms with the vector normal to the surface to be machined at said machining point a constant angle throughout the machining procedure.

SUMMARY OF THE INVENTION

The object of the invention is to improve the machining devices and methods the precision whereof is adapted to the machining of optical objects.

To this end, the invention is directed to a method of machining a face of an optical object, including a step of providing a machine tool that itself includes:

- a table for mounting an object to be machined, this table, which includes a receiving surface, being orientable angularly about an axis transverse to the receiving surface;
- a spindle adapted to drive a machining tool in rotation about an axis substantially parallel to the receiving surface of the table and adapted to move this machining tool in translation in a plane substantially parallel or perpendicular to the receiving surface of the table;

this method being characterized in that it further includes the following steps:

a) fixing a support to the table so that this support projects transversely to the table;

b) fixing to the support of the optical object to be machined so that said face to be machined is disposed transversely to the receiving surface of the table;

c) machining of said face by the machining tool along a trajectory substantially parallel to the receiving surface of the table, the table being angularly oriented as the machining proceeds so that the machining tool is always in contact with said face on a predetermined same parallel and that a predetermined angle is maintained between the rotation axis of the machining tool and the normal to said face at the point of contact with the machining tool.

Such a method circumvents defects of machining tool shape error type. In the end it guarantees a better appearance of the machined surface and better durability of the machining tool.

The method circumvents the defects of the machining tool by ensuring that the point of contact between this tool and the face to be machined is always situated on a same parallel of the tool, and this on a machine having a rotating table and a machining tool mobile in translation.

This method further enables a trajectory of the machining tool that involves, in the first place, lower levels of acceleration and that, in the second place, is free of problems of reversing the trajectory. The spindles of the machine tool therefore do not need to be overspecified and wear of the tools is more regular.

For example, compared to a standard spiral machining trajectory, these advantages linked to the levels of acceleration and to reversing problems are complemented by the fact that, along the Cartesian trajectories enabled by the invention, there is no singular point at the center of the lens where, along a spiral trajectory, the rate of advance is zero at the center. Moreover, the machine tool of the invention enables machining of only the necessary portion of the lens.

According to preferred features, taken separately or in combination:

- the method further includes the following steps, after the step c):
  - moving the machining tool in translation in a direction substantially perpendicular to the receiving surface of the table;
  - where applicable, repetition of the step c);
- the method further includes the following step, before the step c):
  - machining of said face by the machining tool along a trajectory substantially perpendicular to the receiving surface of the table, the table being angularly oriented as the machining proceeds so that the machining tool is always in contact with said face along a predetermined same parallel and that a predetermined angle is maintained between the rotation axis of the machining tool and the normal to said face at the point of contact with the machining tool;
- the machining method further includes, before the step c), a step of plotting the dynamic contour of the machining tool;
- the plotting of the dynamic contour of the machining tool is effected by driving the machining tool in front of means for plotting a profile;
- the step of plotting the dynamic contour of the machining tool is followed by a step of selecting a predetermined parallel;
- said predetermined parallel is selected from the planes perpendicular to the rotation axis of the machining tool and that intersect the dynamic contour of the machining tool;
- the step of selecting a predetermined parallel is followed by a step of determining the dynamic center of the machining tool;
- the step of determining the dynamic center is effected by determining the intersection between the normal to the dynamic contour of the machining tool at one of the points of intersection between the predetermined parallel and the contour of the machining tool, and the rotation axis of the machining tool;

the step c) is effected by angularly orienting the table as the machining proceeds so that the normal to said face to be machined at the point of contact between the machining tool and said face passes through the dynamic center of the machining tool;

the distance between the point of contact and the dynamic center is substantially equal to the dynamic radius of the machining tool;

the machining method further includes the following step: machining of said face by the machining tool along a trajectory parallel to the receiving surface of the table and in the opposite direction to that of the step c), the machining tool turning in the same direction.

Another object of the invention is a machine tool adapted to the implementation of the method previously indicated, characterized in that it includes a rotating table having a receiving surface and a spindle adapted to drive a machining tool in rotation about an axis substantially parallel to the receiving surface of the rotating table and adapted to move this machining tool in translation in a plane substantially parallel to the receiving surface of the table, and a support fixed to the table so that this support projects transversely to the table, this support including means for holding the optical object so that the face to be machined of the optical object is disposed transversely to the receiving surface of the rotating table.

According to preferred features, taken separately or in combination:

the spindle is also adapted to move the machining tool in translation in a direction substantially perpendicular to the receiving surface of the rotating table;

the machine further includes means for driving the machining tool in rotation disposed facing means for plotting a contour.

BRIEF DESCRIPTION OF THE DRAWING FIGURES

Other features and advantages of the invention become apparent in the light of the following description of a preferred embodiment given by way of nonlimiting example, which description is given with reference to the appended drawings, in which.

DETAILED DESCRIPTION OF THE INVENTION

Figure 1:
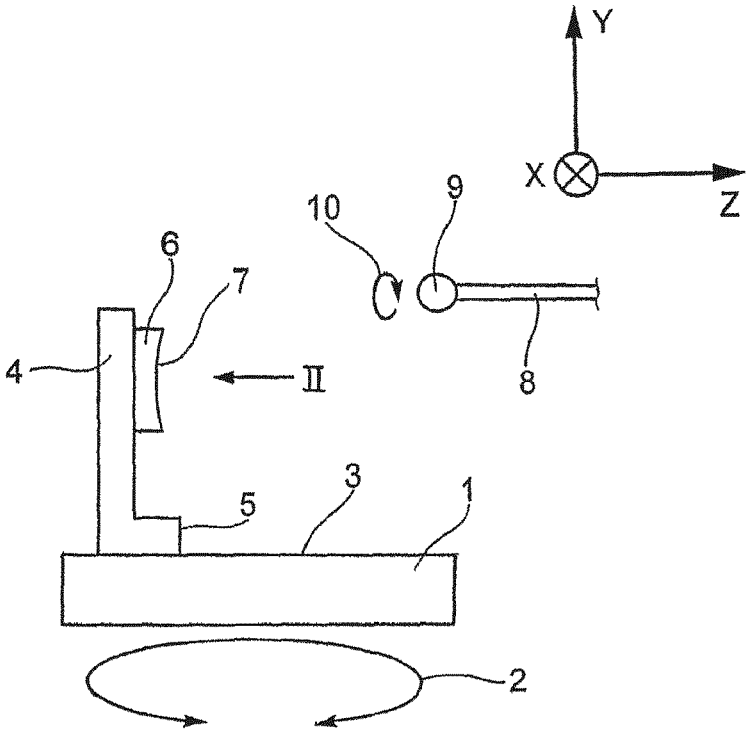
FIG. 1 is a diagrammatic view of the operative members of a machine tool of the invention.

In the FIG. 1 diagrammatic view, the machine tool represented includes a rotating table 1 (seen from the side in this figure) of circular shape. This rotating table 1 can be oriented angularly about an axis perpendicular to its center in both directions (arrow 2 in FIG. 1).

The rotating table 1 has a receiving surface 3 at the top.

A bracket 4 is fixed, for example screwed, to the receiving surface 3 so that a mounting surface 5 of the bracket 4 projects perpendicularly to the receiving surface 3.

The bracket 4 includes jaws (not shown) adapted to hold an optical object, which is an ophthalmic lens 6 in the present example, so that a surface 7 to be machined of the ophthalmic lens 6 is disposed transversely to the receiving surface 3.

This machine tool also includes a spindle 8 on which is mounted a machining tool 9 which in the present example is a grinding tool with a spherical bearing surface. The spindle 8 is adapted to drive the tool 9 in rotation as shown by the arrow 10 and to move this tool 9 in translation in the three directions X, Y and Z to enable the tool 9 to machine the entire surface 7 of the ophthalmic lens 6.

Here the spindle 8 is parallel to the axis Z.

In a variant, the spindle 8 is inclined relative to the axis Z.

In another variant the movement of the tool 9 in the three directions X, Y and Z can be effected via a fixed spindle 8 and a rotating table 1 that is itself mobile in translation in the directions X, Y and Z.

Generally speaking, any combination of movements of the tool 9 and the rotating table 1 enabling such relative movement of the tool 9 and the rotating table 1 is an acceptable variant.

Figure 2:
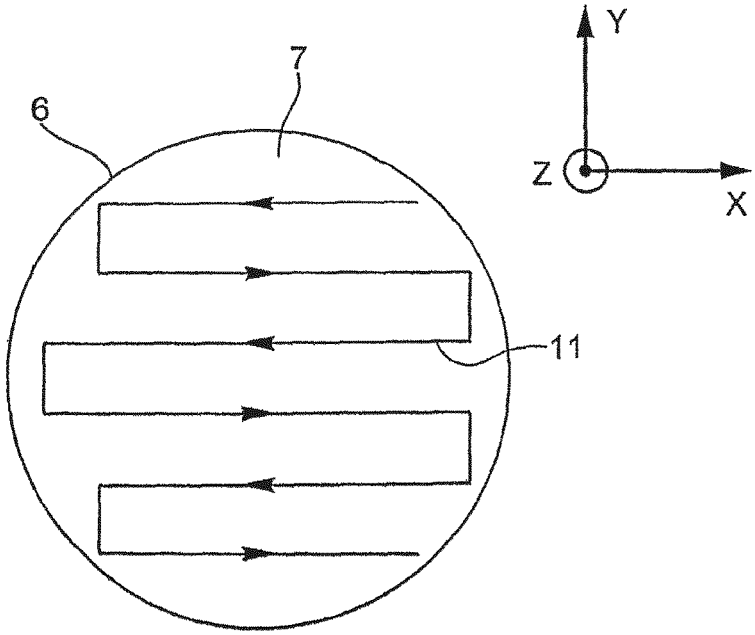
FIG. 2 is a view of the face to be machined of an optical object on which the trajectory of the machining tool is represented diagrammatically.

The surface 7 to be machined, which is seen from above in FIG. 2, is machined here along a fluted trajectory represented diagrammatically by the line 11. Thus the machining is effected in the form of a series of passes of the tool 9 driven in rotation and moved along a trajectory parallel to the receiving surface 3.

In this FIG. 2, the surface to be machined appears from the front as a disc, it being understood that the lens 6 is curved and that this surface 7 to be machined is therefore not plane.

The machining of the surface 7 of an ophthalmic lens 6 by the FIG. 1 set-up proceeds in the manner described below.

Figure 3:
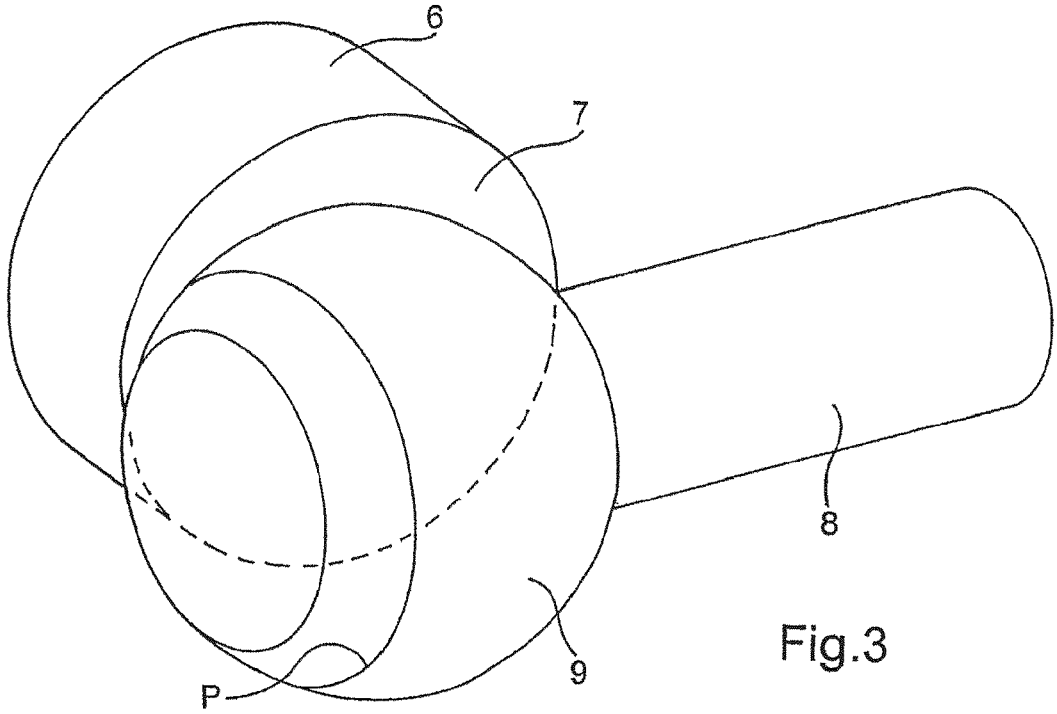
FIG. 3 is a three-dimensional view illustrating the cooperation between the optical object and the machining tool.

The relative angular position of the surface 7 with respect to the tool 9 is effected along a predetermined same parallel. FIG. 3 illustrates in three dimensions the tool-part relative positioning on a same parallel P of the tool 9.

Figure 4:
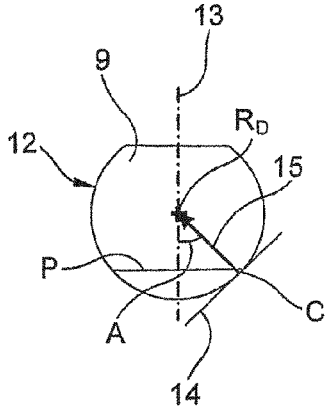
FIGS. 4 and 5 are diagrammatic views illustrating the theoretical principle of machining along a predetermined same parallel.
Figure 5:
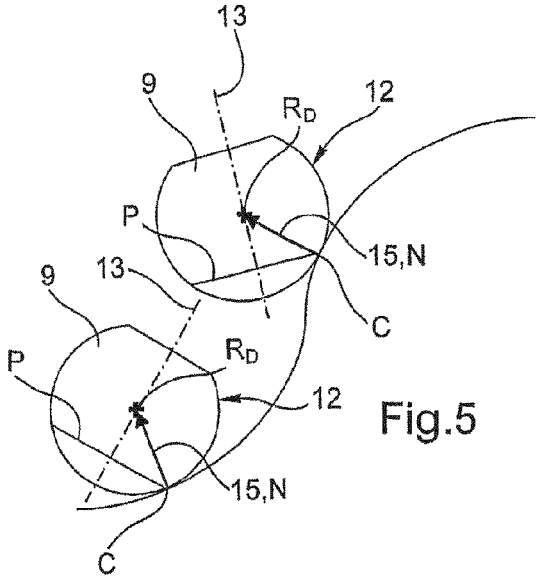

The principle of machining on a predetermined same parallel P of the tool 9 is illustrated theoretically in two dimensions in FIGS. 4 and 5.

Figure 11:
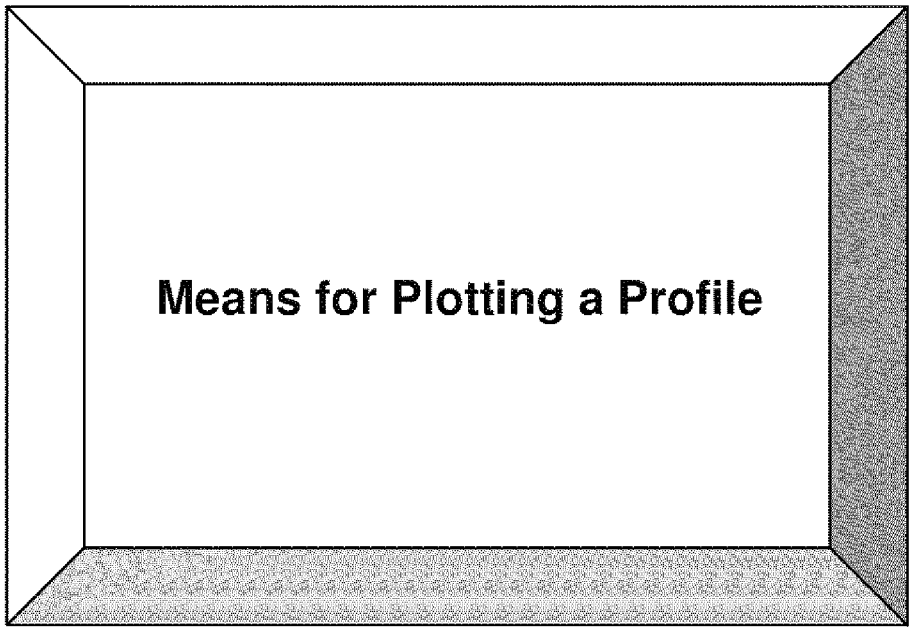
FIG. 11 is a view of a means for plotting a profile.

Before being mounted on the spindle 8, the tool 9 is mounted on equipment for determining its dynamic profile. This equipment is adapted to rotate the tool 9. The dynamic profile of the tool is plotted, for example, by placing the tool 9 between a parallel light beam and a screen so that the shadow of the tool 9 projected onto the screen takes account of this dynamic profile 12, or by filming the rotating tool 9 and displaying this image on a screen (see FIG. 11).

The dynamic profile measuring equipment also enables manual or electronic manipulation of this image and measurement and tracing on this dynamic profile 12.

For better precision, especially in the case where the tool 9 is a finishing tool, the tool can be trued and balanced directly on the spindle, after which its dynamic profile is measured.

There is then chosen a parallel P on this dynamic profile that appears in the figures in the form of a segment perpendicular to the rotation axis 13 of the tool 9 about which the dynamic profile 12 is symmetrical.

This parallel P is determined by the intersection of a plane perpendicular to the rotation axis 13 of the tool 9 and the dynamic profile 12 of the tool 9.

There is then determined on the profile 12 the tangent 14 to the contour of the dynamic profile at the point of intersection between one of the ends of the parallel P and the contour of the profile 12.

The perpendicular 15 to the tangent 14 at the point C cuts the rotation axis 13 at a point $R_D$ which is the dynamic radius of the tool 9. This perpendicular 15 is therefore the normal to the dynamic profile 12 at the point C.

The machining is then carried out so that, in the first place, the tool 9 is always in contact with the surface to be machined at the point C, that is to say, the tool being a rotary tool, always on the same parallel P, and that, in the second place, the relative angular orientation between the tool and the surface to be machined is such that the normal N to the surface to be machined at the point of contact C passes through the point $R_D$, in other words coincides with the perpendicular 15.

FIG. 5 shows two possible positions of the tool 9 along a surface 7 to be machined conforming to the above principles.

Figure 6:
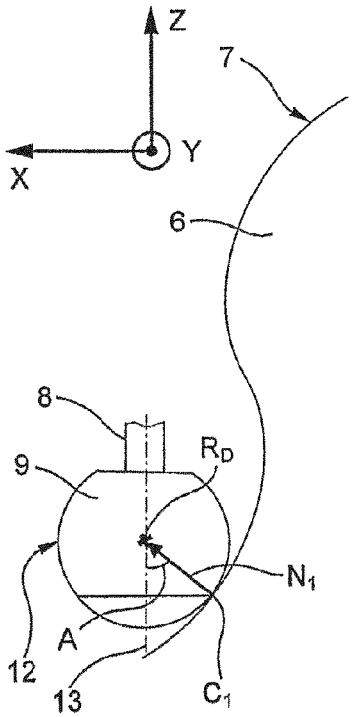
FIGS. 6 and 7 are diagrammatic views illustrating the implementation of the principle illustrated in FIGS. 3 and 4 by the FIG. 1 machine.
Figure 7:
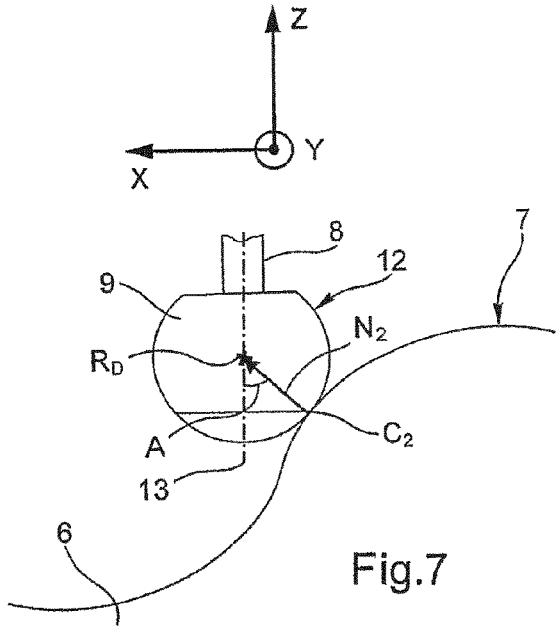

In the FIG. 1 machine, these principles are applied in accordance with FIGS. 6 and 7, which are views from above with respect to the FIG. 1 representation.

When the tool 9 is moved up into contact with the surface 7, as in FIG. 6, the rotating table 1 is angularly oriented so that the surface 7 is placed as shown in FIG. 6, i.e. so that the normal N to the surface 7 at the point of contact C passes through the center $R_D$, which implies that the angle A between this normal N and the rotation axis 13 of the tool 9 is always preserved.

Localized-type machining is effected. This means that the same place on the spherical generatrix of the grinding tool is always used. All grinding tool/part points of contact will therefore form a circle lying in a plane orthogonal to the axis of the tool. The position of this plane relative to the center of the grinding tool is defined by the angle A.

The tool 9 is then moved along a trajectory parallel to the receiving surface 3 of the rotating table 1, i.e. in the X, Z plane.

FIG. 7 shows another position of the tool 9 after movement. The rotating table 1 has been oriented angularly, as before, so that the normal $N_2$ at the point $C_2$ passes through the point $R_D$. This angular orientation of the rotating table 1 is effected as the tool 9 travels over the surface 7 to be machined. Once this travel has been completed from one lateral extremity of the ophthalmic lens to the other, the tool 9 is moved in translation perpendicularly to the receiving surface 3, i.e. along the axis Y, as shown in FIG. 2, after which a new pass in the X, Z plane is carried out in the same manner. These operations are repeated until the surface 7 has been machined completely.

It is therefore mandatory that the normal at the contact should coincide with the normal of the tool. This means that, the tool here being quasi-spherical, the normal to the part must pass through the center of the grinding tool.

Example of a Machining Configuration

The machining point $C(X, Y, Z)_{part}$ and its normal $\vec{N}_p(U, V, W)_{part}$ in the system of axes of the part are known.

The grinding tool center point $R_D(X_{gt}, Y_{gt}, Z_{gt})_{part}$ and its direction $\vec{N}_p(U_{gt}, V_{gt}, W_{gt})_{part}$ in the system of axes of the part are what is being looked for.

Calculation of the Angle B

The grinding tool system of axes ($\vec{X}_{grinding\ tool}$, $\vec{Y}_{grinding\ tool}$, $\vec{Z}_{grinding\ tool}$) is defined, which is a rectangular system of axes with its origin at the center of the grinding tool and colinear with the direction of the grinding tool.

What is to be determined is the value of the rotation about the axis Y to be applied so that, at the point C, the normal to the surface passes through the generatrix of the cone whose apex is at the center of the grinding tool and whose cone angle is $$\frac{\pi}{2} - A.$$

Let B denote this angle.

The normal at the point C expressed in the part system of axes is such that:

$$\vec{N} = U\vec{X}_p + V\vec{Y}_p + W\vec{Z}_p.$$

After transposing the angle B into the system of axes of the grinding tool, we obtain:

$$\vec{N} = U(\vec{Z}_{gt}\cos B - \vec{X}_{gt}\sin B) + V\vec{Y}_{gt} + W(\vec{Z}_{gt}\sin B + \vec{X}_{gt}\cos B).$$

The coordinate of the vector $\vec{N}$ in the system of axes of the grinding tool after transposition is obtained in the form:

$$\vec{N} = (-U\sin B + W\cos B)\vec{X}_{gt} + V\vec{Y}_{gt} + (U\cos B + W\sin B)\vec{Z}_{gt}$$

What is required is for this "transposed" normal to form an angle of $$\frac{\pi}{2} - A$$

with the oriented axis of the grinding tool; we can therefore write that the scalar product of $\vec{X}_{grinding\ tool}$ by $\vec{N}$ is equal to the cosine of the angle of the cone formed by A.

$$\vec{X}_{gt} \cdot \vec{N} = \cos\left(\frac{\pi}{2} - A\right) = \sin(A)$$

Which is written:

$$-U\sin B + W\cos B = \sin A$$

$$-\sin B + \frac{W}{U}\cos B = \frac{\sin A}{W}$$

$$\text{Setting } \frac{W}{U} = \tan I,$$

the equation becomes:

$$-\sin B + \tan t + \cos B = \frac{\sin A}{W}$$

$$-\cos t \sin B + \sin t \cos B = \frac{\sin A}{U}\cos t$$

If the condition $$-1 \le \frac{\sin A}{U}\cos t \le 1$$

is respected, we may set:

$$\frac{\sin A}{U}\cos t = \sin q$$

The equation then becomes:

$$-\cos t \sin B + \sin t \cos B = \frac{\sin A}{U}\cos t$$

$$\sin(t - B) = \sin q$$

That is:

$$t-B=q \text{ or } t-B=\pi-q$$

Thus:

$$B = -\pi + \arcsin\left(\frac{\sin A}{U}\cos\left(\arctan\frac{W}{U}\right)\right) + \arctan\frac{W}{U}$$

or $$B = -\arcsin\left(\frac{\sin A}{U}\cos\left(\arctan\frac{W}{U}\right)\right) + \arctan\frac{W}{U}$$

We know that $$\cos\left(\arctan\frac{W}{U}\right) = \frac{U}{\sqrt{U^2+W^2}},$$

from which we deduce:

$$B = -\pi + \arcsin\left(\frac{\sin A}{\sqrt{U^2+W^2}}\right) + \arccos\left(\frac{U}{\sqrt{U^2+W^2}}\right)$$

$$B = -\arcsin\left(\frac{\sin A}{\sqrt{U^2+W^2}}\right) + \arccos\left(\frac{U}{\sqrt{U^2+W^2}}\right)$$

That is:

$$B = -\pi + \arcsin\left(\frac{\sin A}{\sqrt{U^2+W^2}}\right) + \arcsin\left(\frac{W}{\sqrt{U^2+W^2}}\right)$$

or

-continued $$B = -\arcsin\left(\frac{\sin A}{\sqrt{U^2+W^2}}\right) + \arcsin\left(\frac{W}{\sqrt{U^2+W^2}}\right)$$

It has been assumed that:

$$-1 \le \frac{\sin A}{U}\cos t \le 1$$

$$-1 \le \left(\frac{\sin A}{\sqrt{U^2+W^2}}\right) \le 1$$

$$\sin^2 A \le U^2 + W^2$$

$$\cos^2 A \ge V^2$$

The condition to be verified for the angle to be correct is $\cos^2 A \geqq V^2$.

We choose for B:

$$B = -\pi + \mathrm{Arcsin}\left(\frac{W}{\sqrt{U^2+W^2}}\right) + \mathrm{Arcsin}\left(\frac{\sin A}{\sqrt{U^2+W^2}}\right)$$

with the following condition:

$$\cos^2 A \geqq V^2$$

Calculation of the Direction of the Grinding Tool

The angle B being defined, the direction of the grinding tool $\vec{N}=(U_{gt}, V_{gt}, W_{gt})_{part}$ in the part system of axes can be deduced therefrom.

$$\vec{N} = \begin{pmatrix} U_{gt} = \sin B \\ V_{gt} = 0 \\ W_{gt} = \cos B \end{pmatrix}_{part\ system\ of\ axes}$$

Calculation of the Position of the Center of the Grinding Tool

Here it is a question of calculating the position to be imparted to the center of the grinding tool $R_D(X_{gt}, Y_{gt}, Z_{gt})_{part}$ to machine the point $C(X, Y, Z)_{part}$ with normal $\vec{N}(U, V, W)_{part}$ in the part system of axes.

O: origin of the part system of axes.

C: machining point.

$R_D$: center of the grinding tool.

We have:

$$\vec{OR_D} = \vec{OC} + \vec{CR_D}$$

$$\vec{OC} = X\vec{X}_p = Y\vec{Y}_p + Z\vec{Z}_p$$

$$\vec{CR_D} = R_{grinding\ tool}\vec{N}$$

$$\vec{CR_D} = (R_{grinding\ tool}U)\vec{X}_p + (R_{grinding\ tool}V)\vec{Y}_p + (R_{grinding\ tool}W)\vec{Z}_p$$

where $R_{grinding\ tool}$ is the radius of the grinding tool.

Whence the position of the center of the grinding tool:

$$\vec{OR_D} = (X + R_{grinding\ tool}U)\vec{X}_p + (Y + R_{grinding\ tool}V)\vec{Y}_p + (Z + R_{grinding\ tool}W)\vec{Z}_p$$

-continued $$C = \begin{pmatrix} X + R_{grinding\ tool}U \\ Y + R_{grinding\ tool}V \\ Z + R_{grinding\ tool}W \end{pmatrix}_{grinding\ tool\ system\ of\ axes}$$

The machining can be carried out in two steps:

A first step in which the tool is positioned so that the normal of the point to be machined is "parallel to the surface of the cone".

A second step in which the machining point is brought into contact with the point to be machined.

Thus, during machining, the tool is worn symmetrically on each side of the parallel P that has been chosen, which improves prediction and control of this wear. What is more, the tool 9 machines the surface 7 by attacking the material perpendicularly to the trajectory of movement of the tool 9, which circumvents machining defects inherent to the machining mode in which the material is either "swallowed" or "pushed", when the tool attacks the material parallel to its trajectory of movement.

The parallel P is chosen as a function of the shape of the surface 7 to be machined so that no portion of this surface 7 is inaccessible to this parallel P given the possible angular movements between the tool 9 and the rotating table 1 and taking into account the overall size of the spindle 8.

Figure 8A:
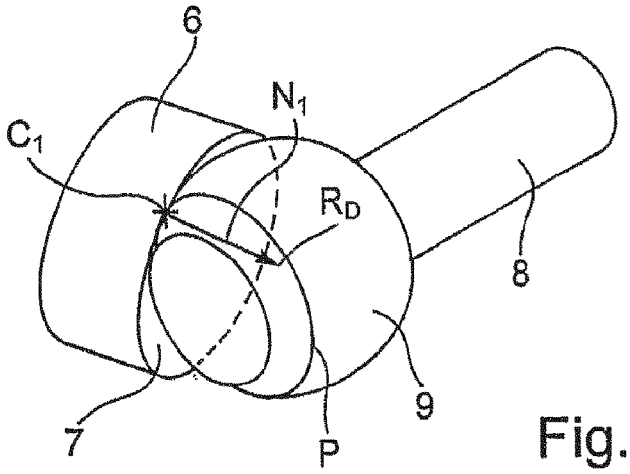
FIG. 8A is a three-dimensional view similar to FIG. 3 illustrating in the form of an arrow the normal at the point of contact of the surface to be machined.
Figure 8B:
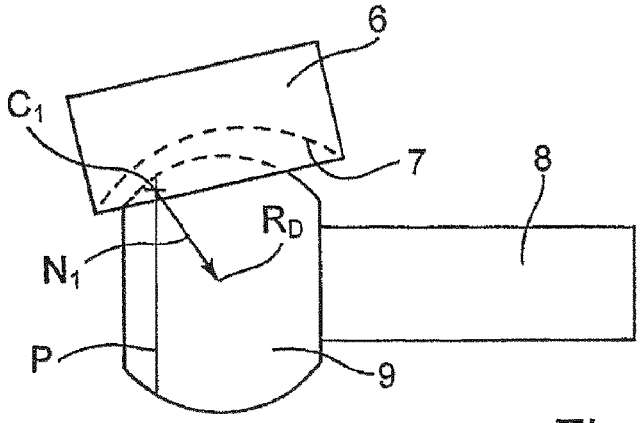
FIGS. 8B and 8C are two-dimensional views of FIG. 8A respectively from above and from the front.
Figure 8C:
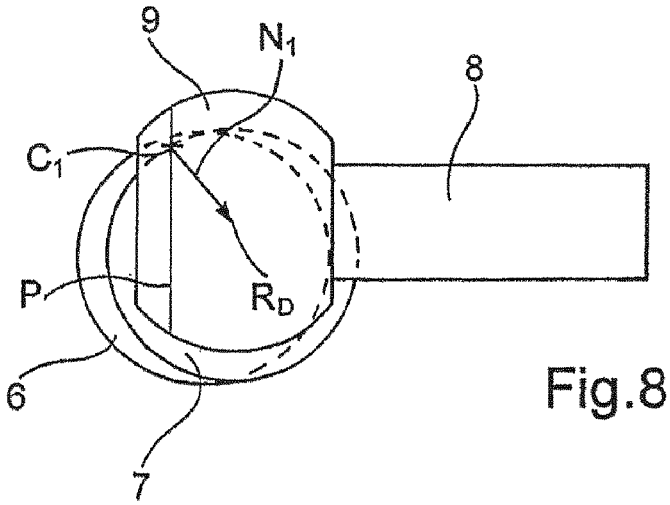
Figure 9A:
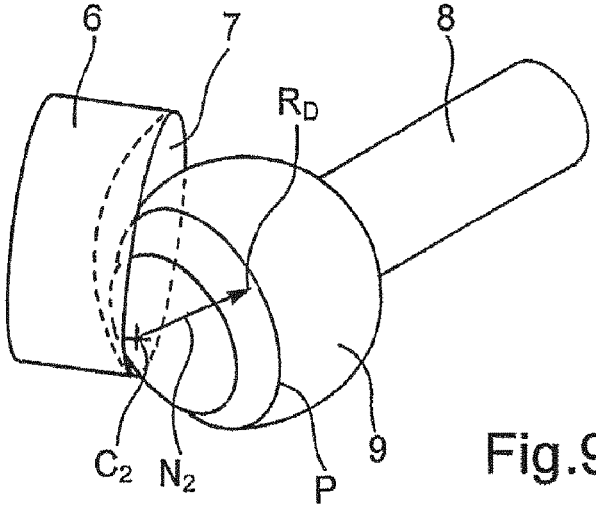
FIGS. 9A, 9B and 9C are similar to FIGS. 8A, 8B and 8C, respectively, but for another point of contact between the optical object and the machining tool.
Figure 9B:
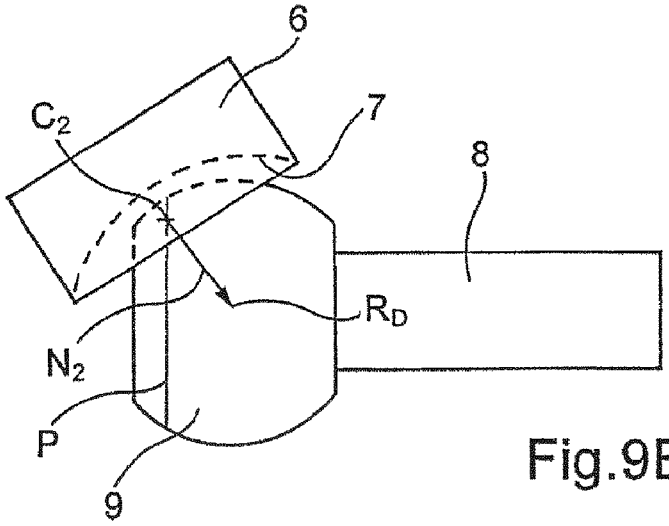
Figure 9C:
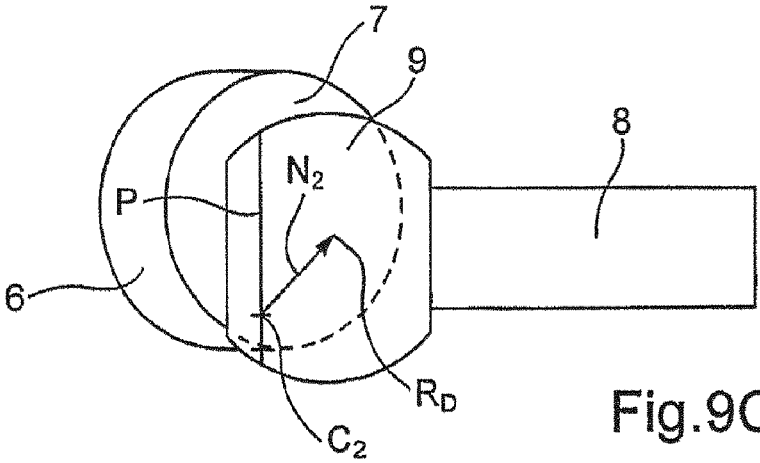

The machining operations described with reference to FIGS. 6 and 7 take place in three dimensions, of course, as FIGS. 8A to 9C illustrate. FIGS. 8A to 8C show the machining of the lens 6 by the tool 9 at a first point of contact C1 (as in FIG. 6), whereas FIGS. 9A to 9C show the machining of the lens 6 by the tool 9 at a second point of contact C2 (as in FIG. 7).

In each of these FIGS. 8A to 9C the normal N at the point of contact C of the surface 7 to be machined is represented. The passage from the point of contact C1 in FIGS. 8A to 8C to the point of contact C2 in FIGS. 9A to 9C shifts the normal N from its position N1 to its position N2, of course. This normal N evolves as a function of the point of contact C within a conical volume.

Variants of the machining method and machine can be envisaged without departing from the scope of the invention. In particular, the machine tool can include two separate spindles, a first spindle for rough machining and a second spindle for finishing and semi-finishing of the optical object, such as an ophthalmic lens, a mold or an insert. The machine tool can advantageously further include a tool changer adapted to position a tool 9 on the spindle.

Figure 10:
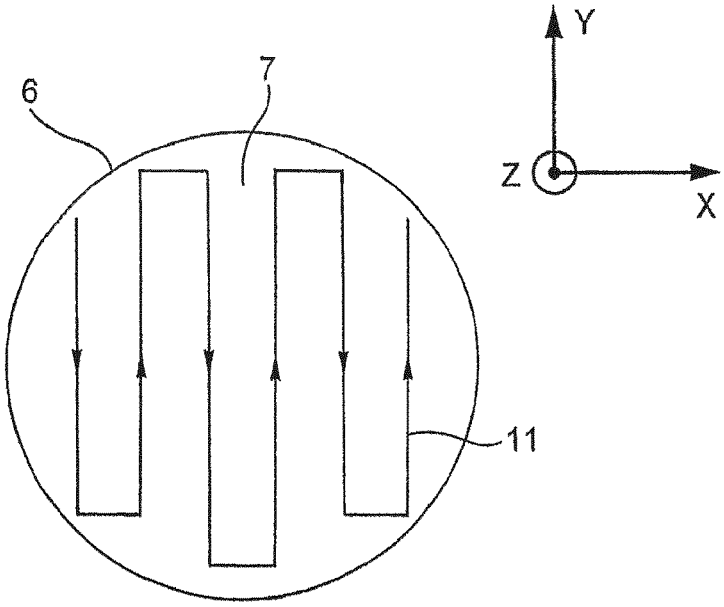
FIG. 10 is a view of an angular tool-part trajectory 11' offset 90° relative to that of FIG. 2.

The above description relates to a tool-part trajectory conforming to FIG. 2, which has the advantage of machining without swallowing or pushing the material, although it is to be understood that the invention can equally well be implemented along an angular tool-part trajectory 11' offset 90° relative to that of FIG. 2 (see FIG. 10).

The invention claimed is:

1. A method of machining a face (7) of an optical object (6), comprising:

providing a machine tool that includes:

a table (1) for mounting an object to be machined, the table (1) including a receiving surface (3) configured to be orientable angularly about an axis transverse to the receiving surface (3); and a spindle (8) adapted to drive a spherical machining tool (9) in rotation about an axis substantially parallel to the receiving surface (3) of the table (1) and adapted to move the machining tool (9) in translation in a plane substantially parallel or perpendicular to the receiving surface (3) of the table (1);

a) fixing a support (4) to the table (1) so that the support (4) projects transversely to the table (1);

b) fixing to the support (4) the optical object (6) to be machined so that said face (7) to be machined is disposed transversely to the receiving surface (3) of the table (1); and c) machining said face (7) by the machining tool (9) along a trajectory substantially parallel to the receiving surface (3) of the table (1), the table (1) being angularly oriented as the machining proceeds so that the machining tool (9) is always in contact with said face (7) on a predetermined parallel (P) and that a predetermined angle (A) is maintained between a rotation axis (13) of the machining tool (9) and a normal (N) to said face (7) at a point of contact (C) with the machining tool (9).

2. The machining method according to claim 1, further including the following step, after the step c):

moving the machining tool (9) in translation in a direction substantially perpendicular to the receiving surface (3) of the table (1).

3. The machining method according to claim 2, further including the following additional step:

repetition of the step c).

4. The machining method according to claim 1, further including the following step, before the step c):

machining of said face (7) by the machining tool (9) along a trajectory substantially perpendicular to the receiving surface (3) of the table (1), the table (1) being angularly oriented as the machining proceeds so that the machining tool (9) is always in contact with said face (7) along the predetermined parallel (P) and that the predetermined angle (A) is maintained between the rotation axis (13) of the machining tool (9) and the normal (N) to said face (7) at the point of contact (C) with the machining tool (9).

5. The machining method according to claim 1, further including, before the step c), a step of plotting the dynamic contour (12) of the machining tool (9).

6. The machining method according to claim 5, wherein the plotting of the dynamic contour (12) of the machining tool (9) is effected by driving the machining tool (9) in front of means for plotting a profile.

7. The machining method according to claim 6, wherein the step of plotting the dynamic contour of the machining tool (9) is followed by a step of selecting the predetermined parallel (P).

8. The machining method according to claim 7, wherein said predetermined parallel (P) is selected from planes perpendicular to the rotation axis (13) of the machining tool (9) and that intersect the dynamic contour (12) of the machining tool (9).

9. The machining method according to claim 7, wherein the step of selecting a predetermined parallel (P) is followed by a step of determining a dynamic center ($R_D$) of the machining tool (9).

10. The machining method according to claim 9, wherein the step of determining the dynamic center ($R_D$) is effected by determining an intersection between the normal (15) to the dynamic contour (12) of the machining tool (9) at one of a plurality of points of intersection between the predetermined parallel (P) and the contour of the machining tool (9), and the rotation axis (13) of the machining tool (9).

11. The machining method according to claim 9, wherein the step c) is effected by angularly orienting the table (1) as the machining proceeds so that the normal (N) to said face (7)

to be machined at the point of contact (C) between the machining tool (9) and said face (7) passes through the dynamic center ($R_D$) of the machining tool (9).

12. The machining method according to claim 11, wherein a distance between the point of contact (C) and the dynamic center ($R_D$) is substantially equal to a dynamic radius of the machining tool (9).

13. The machining method according to claim 1, further including the following step:

machining of said face (7) by the machining tool (9) along a trajectory parallel to the receiving surface (3) of the table (1) and in the opposite direction to that of the step c), the machining tool (9) turning in the same direction.

14. A machine tool adapted for implementation of the method according to claim 1, the machine tool comprising:

the rotating table (1) having the receiving surface (3);

the spindle (8) adapted to drive the machining tool (9) in rotation about the axis substantially parallel to the receiving surface (3) of the rotating table (1) and adapted to move the machining tool (9) in translation in the plane substantially parallel to the receiving surface (3) of the table (1); and the support (4) fixed to the table (1) so that the support (4) projects transversely to the table (1), the support (4) including means for holding the optical object (6) so that the face (7) to be machined of the optical object (6) is disposed transversely to the receiving surface (3) of the rotating table (1).

15. The machine tool according to claim 14, wherein the spindle (8) is also adapted to move the machining tool (9) in translation in a direction substantially perpendicular to the receiving surface (3) of the rotating table (1).

16. The machine tool according to claim 14, wherein the machine tool further includes means for driving the machining tool (9) in rotation disposed facing means for plotting a contour.

17. The machining method according to claim 2, further including, before the step c), a step of plotting the dynamic contour (12) of the machining tool (9).

18. The machining method according to claim 3, further including, before the step c), a step of plotting the dynamic contour (12) of the machining tool (9).

19. The machining method according to claim 4, further including, before the step c), a step of plotting the dynamic contour (12) of the machining tool (9).

20. The machining method according to claim 8, wherein the step of selecting a predetermined parallel (P) is followed by a step of determining a dynamic center ($R_D$) of the machining tool (9).

* * * * *

UNITED STATES PATENT AND TRADEMARK OFFICE

CERTIFICATE OF CORRECTION

PATENT NO. : 8,118,642 B2
APPLICATION NO. : 12/306127
DATED : February 21, 2012
INVENTOR(S) : Coulon et al.

It is certified that error appears in the above-identified patent and that said Letters Patent is hereby corrected as shown below:

On the title page, please amend Item (73) to read as follows:

--(73) Assignee: Essilor International (Compagnie Generale d'Optique), Charenton-le-Pont, (FR)--

Signed and Sealed this
Nineteenth Day of March, 2013

Teresa Stanek Rea
*Acting Director of the United States Patent and Trademark Office*